United States Patent [19]

Mototsuna et al.

[11] Patent Number: 4,488,500

[45] Date of Patent: Dec. 18, 1984

[54] DEVICE FOR PREVENTING BOTTOM OF SHIPS HOLD FROM BEING COOLED BY LEAKED LIQUID FROM LOW TEMPERATURE LIQUID STORAGE TANK CARRIED BY SHIP

[75] Inventors: Kazumichi Mototsuna; Takashi Fujitani, both of Tokyo; Yoshito Okumura, Omiya; Iwao Nemoto, Chiba; Shuichi Kitaguchi, Tokyo, all of Japan

[73] Assignee: Ishikawajima-Harima Jukogyo Kabushiki Kaisha, Tokyo, Japan

[21] Appl. No.: 502,157

[22] Filed: Jun. 8, 1983

[51] Int. Cl.[3] ..... B63B 25/16

[52] U.S. Cl. ..... 114/74 A; 220/1 C; 220/901

[58] Field of Search ..... 114/74 A; 220/1 C, 901

[56] References Cited

U.S. PATENT DOCUMENTS

| | | | |
|---|---|---|---|
| 3,547,301 | 12/1970 | Ffooks | 114/74 A |
| 3,605,425 | 9/1971 | Cuneo et al. | 114/74 A |
| 4,079,689 | 3/1978 | Llorente | 114/74 A |
| 4,245,748 | 1/1981 | Kvamsdal | 114/74 A |

*Primary Examiner*—Sherman D. Basinger

[57] ABSTRACT

In a ship for carrying a low temperature liquid storage tank which is supported on the bottom of a ship's hold by especially horizontal displacement preventive tank supporting structures, a leaked liquid receiving pan is disposed below an engaging member which is extended downwardly from the bottom of the tank. The low temperature liquid leaked from the tank and falling between the engaging member and a heat insulating layer surrounding the tank is received by the leaked liquid receiving pan and does not reach the bottom of the ship's hold, whereby the bottom of the hold is prevented from being cooled.

2 Claims, 5 Drawing Figures

DEVICE FOR PREVENTING BOTTOM OF SHIPS HOLD FROM BEING COOLED BY LEAKED LIQUID FROM LOW TEMPERATURE LIQUID STORAGE TANK CARRIED BY SHIP

BACKGROUND OF THE INVENTION

The present invention relates to generally a ship for carrying low temperature liquid such as a liquefied natural gas (LNG) carrier and more particularly a device for receiving liquid leaked from a liquid storage tank which is supported on the bottom of a ship's hold by means of storage tank supporting structures.

FIG. 1 shows in section, a LNG carrier. Within a ship's hull 1, a tank 3 which is surrounded with a heat insulating layer 2 is supported on a bottom 4 of a hold by tank supporting structures 5 and 6. If a crack 7 is produced through the wall of the tank 3, the low-temperature LNG leaks and the leaked liquid 8 flows down along the heat insulating layer 2. A liquid-tight layer may be provided, as a countermeasure therefor, along the heat insulating layer 2. However, the tank 3 is supported on the hold bottom 4 by the tank supporting structures 5 and 6 which are extended through the heat insulating layer 2 so that there do exist clearances or gaps between the members of each of the tank supporting structures 5 and 6 and the heat insulating layer 2 and the leaked liquid 7 flows down through such clearances or gaps and cools the structural steel members of the bottom 4. Because such structural steel members are cooled by the leaked liquid locally and at extremely low temperature, the strength of the ship is adversely affected. In order to overcome this problem, there has been proposed to use steel capable of withstanding extremely low temperatures or to provide another heat insulating layer over the bottom 4 for preventing the leaked low temperature liquid from contacting the hold bottom 4, but both schemes are very expensive or uneconomical.

The present invention was made to overcome the above problem and has for its object to prevent a bottom of a ship's hold from being cooled by a leaked liquid by providing a device which is simple in structure. According to the present invention, means for receiving the leaked liquid is disposed below a tank supporting structure and more specifically a horizontal-displacement preventive tank-supporting structure.

The present invention will become more apparent from the following description of preferred embodiments thereof taken in conjunction with the accompanying drawings.

DETAILED DESCRIPTION OF THE PREFERRED EMBODIMENTS

Figure 1:
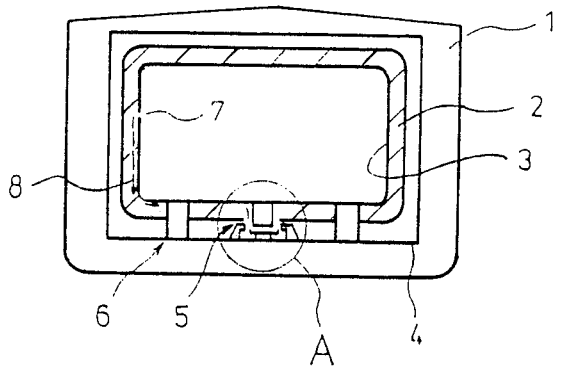
FIG. 1 is a cross sectional view for explanation of an LNG carrier.
Figure 2:
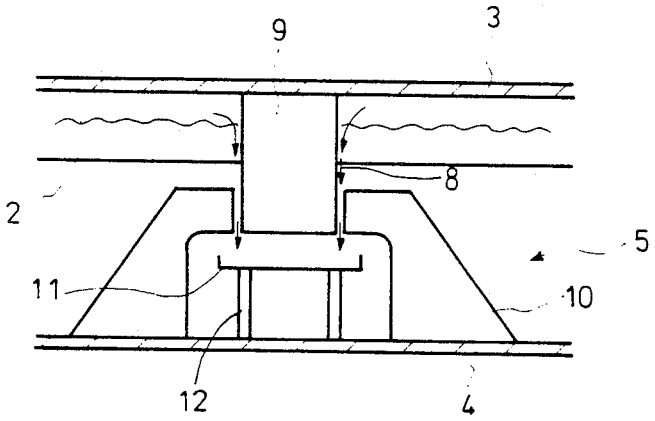
FIG. 2 is a view, on enlarged scale, of an encircled portion A indicated in FIG. 1 and is used for explanation of a first embodiment of the present invention.

FIG. 2 is a view, on enlarged scale, of an encircled portion A indicated in FIG. 1 and shows a first embodiment of the present invention. An engaging member 9 is extended downwardly from the bottom of the tank 3 through the heat insulating layer 2. The tank supporting members 10, which prevent horizontal displacement, are securely anchored to the bottom 4 of the hold in such a way that they oppose to the engaging member 9 extended downwardly beyond the heat insulating layer 2 with a small lateral clearance. Below the lower end of the engaging member 9 is disposed a leaked liquid receiving pan 11 which is substantially larger in area than the cross sectional area of the engaging member 9. The peripheral edge of the leaked liquid receiving pan 11 is bent upright so that a predetermined quantity of the leaked liquid may be received in the pan 11 which is supported by legs 12 made of a heat insulating material or steel for low temperature use.

Therefore, in the tank supporting structure 5, the leaked liquid 8 which flows through the heat insulating layer 2 and along the engaging member 9 can be received in the leaked liquid receiving pan 11 so that the bottom 4 of the hold can be prevented from being directly exposed to and excessively cooled by the leaked liquid 8.

Figure 3:
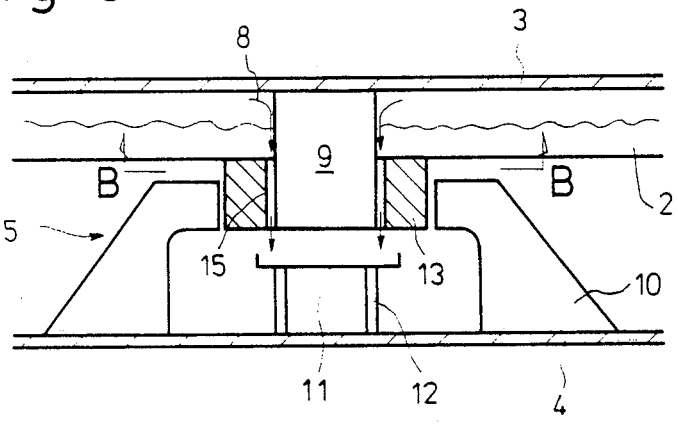
FIG. 3 is a view for explanation of a second embodiment of the present invention.
Figure 4:
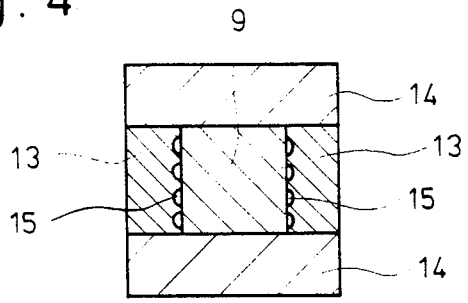
FIG. 4 is a sectional view taken along the lines B—B in FIG. 3.

In FIGS. 3 and 4 is shown a second embodiment. The engaging member 9 is surrounded with heat insulating members 13 and 14 and the heat insulating members 13 which engage with the tank supporting members 9 is made of a material having a relatively high mechanical strength. A plurality of vertical grooves 15 spaced apart from each other by a suitable distance are formed in the inner surface of each of the heat insulating members 13 which face the engaging member 9, so that the leaked liquid may flow down through such grooves 15 to the leaked liquid receiving pan 11.

According to the second embodiment, the bottom 4 can be prevented from being cooled by the thermal conduction through the tank supporting members 9.

Figure 5:
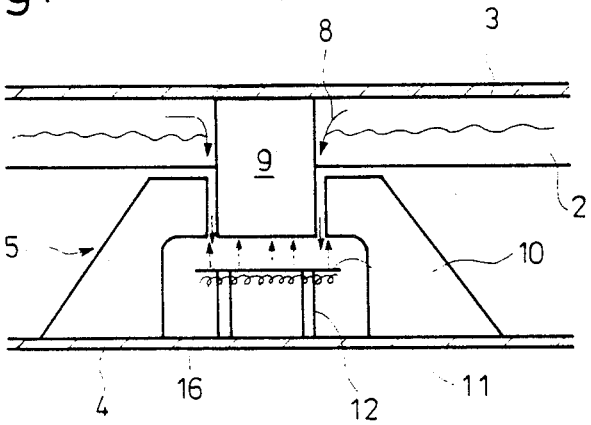
FIG. 5 is a view for explanation of a third embodiment of the present invention.

In FIG. 5 is shown a third embodiment. Heating means 16 are disposed below a leaked liquid receiving pan 11 so that the leaked liquid dropped on the pan 11 can be immediately evaporated and consequently it is not needed to fold the peripheral edge portion of the pan 11 upright as shown in FIG. 2 or 3.

The leaked liquid receiving pan may be in the form of a ring or doughnut whose inner diameter is substantially equal to the outer diameter of the engaging member 9.

It is of course possible to attach the leaked liquid receiving pan directly to the lower end of the engaging member though not shown.

As described above, according to the present invention, the leaked liquid receiving means is extremely simple in construction yet is very effective in preventing an extremely low temperature liquid from contacting the bottom of the hold. As a result, the bottom of the hold can be avoided from being excessively overcooled and the adverse effects resulting from such overcooling can be avoided.

What is claimed is:

1. In combination with a ship's low temperature liquid storage tank carried in the ship's hold having pairs of horizontal displacement preventive tank supporting structures disposed between the bottom of the ship's hold and the bottom of the tank, a heat insulating layer surrounding the tank, and an engaging member extending from the bottom of the tank and through said heat insulating layer to between said supporting structures, whereby gaps exist between said engaging member and said heat insulating layer, a leaked liquid receiving pan means disposed below the engaging member for receiving leaked liquid falling from said gaps, thereby to prevent the bottom of the ship's hold from being cooled by the leaked liquid.

2. The combination according to claim 1 wherein said leaked liquid receiving pan means is heated by heating means.

* * * * *